United States Patent [19]

Erlandson

[11] 4,234,191

[45] Nov. 18, 1980

[54] ARCHERY ARROW HEAD

[76] Inventor: Roger S. Erlandson, 8600 Rubio Dr., Elk Grove, Calif. 95624

[21] Appl. No.: 7,904

[22] Filed: Jan. 31, 1979

[51] Int. Cl.[3] ..... F41B 5/02

[52] U.S. Cl. ..... 273/421

[58] Field of Search ..... 273/106.5 B, 419–422

[56] References Cited

U.S. PATENT DOCUMENTS

| | | | |
|---|---|---|---|
| 2,005,424 | 6/1935 | Kindle et al. | 273/106.5 B |
| 2,676,017 | 4/1954 | Selent et al. | 273/106.5 B |
| 2,684,852 | 7/1954 | Romeka | 273/106.5 B |
| 2,691,527 | 10/1958 | Ramsey | 273/106.5 B |
| 2,816,765 | 12/1957 | Stockbleth | 273/106.5 B |
| 2,820,637 | 1/1958 | La Fond | 273/106.5 B UX |
| 2,940,758 | 6/1960 | Richter | 273/106.5 B |
| 3,398,960 | 8/1968 | Carroll, Jr. | 273/106.5 B |
| 3,910,579 | 10/1975 | Sprandel | 273/106.5 B |

*Primary Examiner*—Paul E. Shapiro
*Attorney, Agent, or Firm*—Donald E. Nist

[57] ABSTRACT

The improved archery arrow head of the present invention is of unitary, integral, one piece plastic construction and includes a main body having a longitudinally extending thickened central core, the body being narrow at its front end and wide at its rear end and generally triangular shaped in plan view. The front end terminates in a forwardly directed sharp point and the rear end defines a forwardly extending opening adapted to receive an arrow shaft. A pair of rearwardly diverging blades which are generally triangular in plan view form the sides of the body and have peripherally disposed cutting edges, the serrations of which are forwardly directed. A central, longitudinal reinforcing and wedging bar extends from the point to adjacent the rear end and projects above and below the main plane of the blades. That main plane is about horizontal. A second smaller pair of blades may be disposed in a vertical plane at the midline of the head. The forward end of the smaller blades begins rearwardly of the forward end of the horizontal blades and the reinforcing and wedging bar extends forward of both pairs of blades. The head is generally diamond shaped in cross section and the blades are generally triangular shaped in cross section. The head is strong, durable, efficient, of very low cost and reusable. The wedging bar aids penetration of the head, as do the forwardly directed serrations.

7 Claims, 8 Drawing Figures

ARCHERY ARROW HEAD

BACKGROUND OF THE INVENTION

1. Field of the Invention

The present invention generally relates to projectiles and more particularly to an improved, integral, unitary plastic archery hunting arrow head.

2. Prior Art

Conventional archery hunting arrow heads contain a plurality of steel razor-sharp blades set into a frame. The head is relatively heavy and is expensive to manufacture. The blade edges may be easily dulled by rust between relatively short, widely spaced hunting seasons. Moreover, the blades are relatively brittle and easily broken if the arrow contacts an object such as a tree limb during flight. The heavy head reduces the distance that the arrow can be shot accurately and imposes limitations on the size and shape of the vanes or feathers on the arrow. A problem of counterbalancing the heavy head exists and the trajectory of the arrow flight is relatively steep.

It would be desirable to be able to provide an archery hunting arrow head of improved construction, particularly one which is light in weight, strong and not subject to dulling through oxidation. The head should preferably be inexpensive, reusable and aerodynamically sound so that higher velocities, greater accuracy and flatter trajectories could be obtained using such heads on hunting arrows.

SUMMARY OF THE INVENTION

The improved archery hunting arrow head of the present invention satisfies all of the foregoing needs. The head is substantially as set forth in the Abstract. Thus it is light in weight, of unitary one-piece integral construction, and can employ two or more blades which are also integral and which include forwardly directed serrated cutting edges for maximum efficiency. The head further includes a central, longitudinal extending wedging and reinforcing bar which facilitates arrow penetration while reinforcing the head so that plastic can be used for its construction without reducing its durability and efficiency. The head can be inexpensively and rapidly manufactured in a single operation using a conventional molding or extrusion process. The plastic can even be selected so that it performs with less chance of damage than a brittle metal head. Further features of the present invention are set forth in the following detailed description and the accompanying drawings.

DRAWINGS

DETAILED DESCRIPTION

FIGS. 1-4

Figure 1:
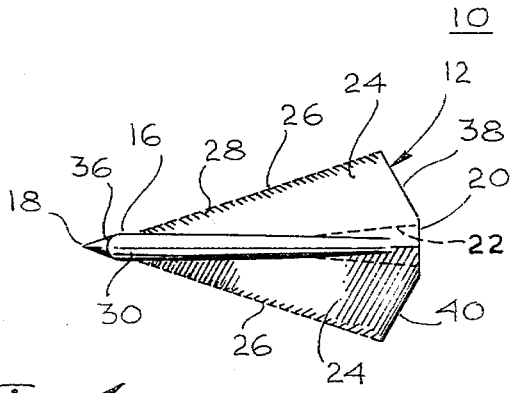
FIG. 1 is a schematic top plan view of a first preferred embodiment of the improved archery hunting arrow head of the present invention.
Figure 2:
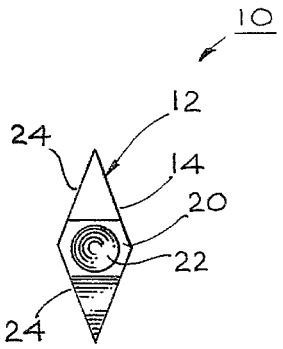
FIG. 2 is a schematic rear elevation of the head of FIG. 1.

Now referring more particularly to the first preferred embodiment of the improved archery hunting arrow head of the present invention, the head 10 is of unitary integral, one piece construction and preferably is fabricated of plastic, such as high impact resistant nylon, a generic term for long-chain synthetic polyamide, or polystyrene, polytetrafluoroethylene, polyurethane or any other suitable moldable or extrudable plastic having sufficiently high strength combined with impact resistance and ability to retain a cutting edge. Head 10 includes a main body 12 having a longitudinally extending thickened central core 14. Body 12 is narrow at its front end and wide at its rear end so that body 12 and head 10 are generally triangular in plan view. The front end 16 of body 12 terminates in a forwardly extending, sharp small point 18 and the rear end 20 of body 12 defines a central forwardly extending opening 22 adapted to receive the front end of an arrow shaft or a connector for an arrow shaft.

Head 10 also includes a pair of blades 24 forming the lateral portions of body 12 and disposed in an about horizontal plane. Blades 24 have rearwardly diverging, peripherally disposed serrated cutting edges 26, the serrations 28 of which are forwardly directed. Head 10 also includes a central reinforcing and wedging bar 30 which extends in body 12 from point 18 to adjacent rear end 20.

Bar 30 extends both above and below the main plane of blades 24 and has two purposes, namely to reinforce the entire structure of head 10 to assure that it is stable and that, particularly, blades 24 are not readily subject to breakage and damage; also, bar 30 extends forward of blades 24 and acts to force open and increase the penetration effected by head 10. Thus, point 18 initiates the penetration, bar 30 accentuates and continues that penetration and then the forwardly directed serrations 28 expand the penetration to the fullest extent, all with a minimum amount of effort so that neither the head is damaged nor the extent of penetration diminished. It will be noted that bar 30 is tapered rearwardly and includes upper arm 32 and lower arm 34 which are integral with and blend into the outer surface of core 14 of body 12. It will also be noted that the front end 36 of bar 30 is rounded to render it aerodynamically sound and to facilitate the previously directed penetration.

Figure 3:
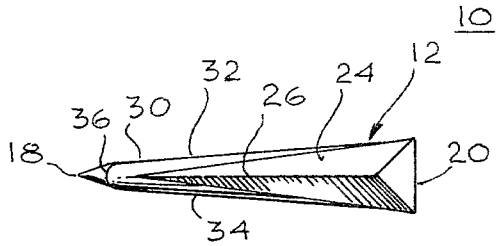
FIG. 3 is a schematic side elevation of the head of FIG. 1.
Figure 4:
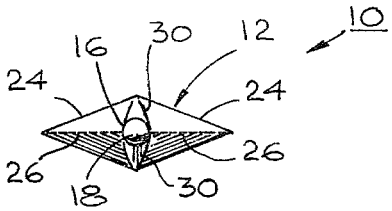
FIG. 4 is a schematic front elevation of the head of FIG. 1.
Figure 5:
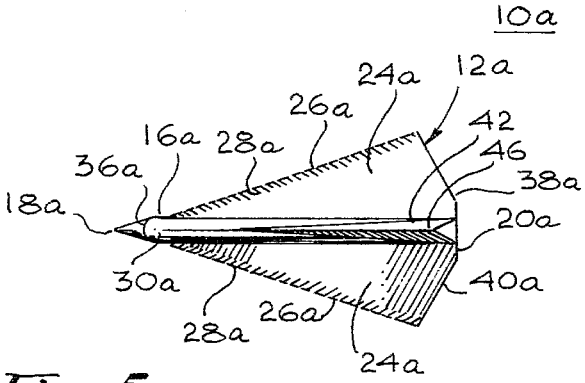
FIG. 5 is a schematic top plan view of a second preferred embodiment of the improved archery hunting arrow head of the present invention.
Figure 6:
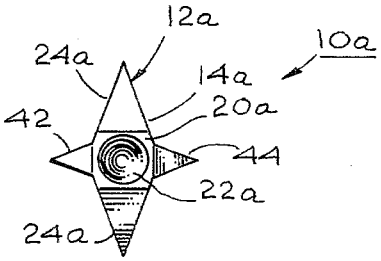
FIG. 6 is a schematic rear elevation of the head of FIG. 5.
Figure 7:
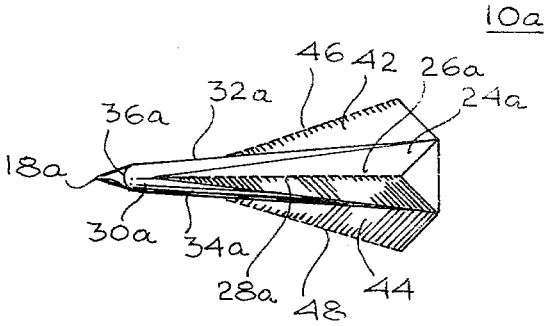
FIG. 7 is a schematic side elevation of the head of FIG. 5.
Figure 8:
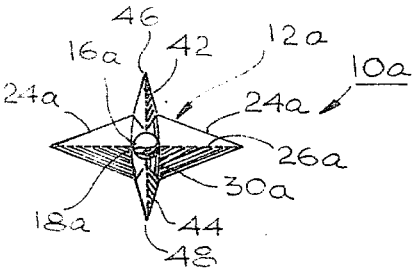
FIG. 8 is a schematic front elevation of the head of FIG. 5.

It will further be noted that head 10 is generally diamond shaped when viewed from either end, the bases of blades 24 approximating each other in core 14. Since blades 24 are triangular in cross section and integral with core 14, they are adequately supported so as not to be easily detached from body 12, broken or otherwise damaged. Head 10 fabricated of plastic is very light and aerodynamically shaped, including the sloped rear sections 38 and 40 thereof, as shown in FIGS. 1 and 3. Moreover, the configuration of head 10 is such that it can be readily molded without mold release problems. Head 10 could be manufactured of other materials than plastic, for example wood, metal, preferably aluminum or the like, or of composition material, such as compressed cellulose, etc. However, head 10 is particularly adapted for manufacture from plastic.

FIGS. 5–8

A second preferred employment of the improved archery hunting arrow head of the present invention is schematically depicted in FIGS. 5–8. Thus, head 10*a* is shown. Head 10*a* is similar to head 10 but is a four-bladed configuration instead of the two-bladed configuration of head 10. Components similar in head 10*a* to those in head 10 bear the same numerals but are succeeded by the letter "a". Thus head 10*a* includes body 12*a* with core 14*a*. The front end 16*a* of body 12*a* ends in point 18*a* and the rear end 20*a* of body 12*a* has an opening 22*a*. Blades 24*a* are disposed in an amount horizontal plane and include serrated edges 26*a* with forwardly directed serrations 28*a*. Bar 30*a* extends forward of blades 24*a* and includes arms 32*a* and 34*a* which, in this instance, are each bifurcated. The front end 36*a* of bar 30 is rounded and head 10*a* also includes the rearwardly sloped portions of 38*a* and 40*a*, as in head 10. Head 10*a* is generally triangular in plan view and generally diamond shaped in end view and blades 24 are triangular in cross section.

Head 10*a*, in addition to blades 24*a*, includes a pair of vertically aligned blades 42 and 44, extending respectively, upwardly and downwardly from body 12*a*, to the vertical midline of head 10*a*. Preferably, blades 42 and 44 bear serrated edges 46 and 48, respectively. Preferably, blades 42 and 44 are of smaller size than blades 24 and their forward ends begin rearwardly of blades 24, as shown particularly in FIGS. 5 and 7. With such a configuration, point 18*a* initiates penetration of the target, bar 30*a* continues that penetration and the main damage is inflected by serrations 28*a*, the serrated edges 46 and 48 merely expanding the opening caused on penetration. Blades 42 and 44 also have effect of helping to stabilize the aerodynamic configuration of head 10*a*, being disposed at right angles to blades 24.

Various other changes, modifications, alterations and additions can be made in the improved archery hunting arrow head of the present invention and in the components and parameters thereof. All such changes, modifications, alterations and additions as are within the scope of the appended claims form part of the present invention.

What is claimed is:

1. An improved plastic archery hunting arrow head, said head being of unitary integral one piece construction, and including:

a. a main plastic body having a longitudinally extending thickened wedge shaped central core, said body being narrow at the front end thereof and wide at the rear end thereof, said front end terminating in a forwardly directed sharp point, and said rear end defining a central forwardly extending opening in said core adapted to receive an arrow shaft;

b. a pair of plastic blades forming the lateral portions of said body and having rearwardly diverging peripherally disposed serrated cutting edges, the serrations of which are forwardly directed; and, c. a thick central plastic reinforcing and wedging bar extending throughout said body from said point to adjacent said rear end, extending forward of said blades and projecting above and below the main plane of said blades, said bar having a rounded front end of substantial thickness.

2. The improved arrow head of claim 1 wherein said blades are disposed in an about horizontal plane.

3. The improved archery arrow head of claim 2 wherein said reinforcing wedging bar is substantially uniform horizontal diameter throughout its length and wherein each said blade is generally triangular both in plan view and in cross section.

4. The improved archery arrow head of claim 3 wherein said arrow head is generally diamond shaped when viewed from either end thereof and wherein the bases of said blades approximate in said core, said blades being of a thickness at their bases which approximates that of said core.

5. The improved archery arrow head of any of claim 2 through 4 wherein said head includes a second pair of said blades disposed in an about vertical plane and projecting above and below said bar and core.

6. The improved archery arrow head of claim 5 wherein said about vertical blades are smaller than said about horizontal blades and the forward end of said about vertical blades is disposed rearwardly of the forward end of said about horizontal blades.

7. The improved archery arrow head of claim 6 wherein said about vertical blades are triangular in cross section and disposed at the vertical midline of said arrow head.

* * * * *